US010132127B2

(12) United States Patent
Hickl

(10) Patent No.: US 10,132,127 B2
(45) Date of Patent: Nov. 20, 2018

(54) COMPACT BAIL SUPPORTED FILL UP AND CIRCULATION TOOL

(71) Applicant: DW Rentals & Service L.P., Boling, TX (US)

(72) Inventor: Matthew J. Hickl, El Maton, TX (US)

(73) Assignee: DW Rentals & Service L.P., Boling, TX (US)

( * ) Notice: Subject to any disclaimer, the term of this patent is extended or adjusted under 35 U.S.C. 154(b) by 10 days.

(21) Appl. No.: 15/491,813

(22) Filed: Apr. 19, 2017

(65) Prior Publication Data

US 2017/0335641 A1 Nov. 23, 2017

Related U.S. Application Data

(63) Continuation-in-part of application No. 14/606,749, filed on Jan. 27, 2015, now Pat. No. 9,732,572.

(51) Int. Cl.
*E21B 21/01* (2006.01)
*E21B 19/16* (2006.01)

(52) U.S. Cl.
CPC ..... *E21B 21/01* (2013.01); *E21B 19/16* (2013.01)

(58) Field of Classification Search
None
See application file for complete search history.

(56) References Cited

U.S. PATENT DOCUMENTS

| | | | |
|---|---|---|---|
| 2,474,846 | A | 7/1949 | Johns |
| 4,997,042 | A | 3/1991 | Jordan et al. |
| 5,191,939 | A | 3/1993 | Stokley |
| 5,735,348 | A | 4/1998 | Hawkins, III |
| 6,578,632 | B2 | 6/2003 | Mullins |
| 6,722,425 | B2 | 4/2004 | Mullins |
| 8,733,454 | B2 | 5/2014 | Bouligny |
| 2003/0034157 | A1 | 2/2003 | Mullins |
| 2006/0249292 | A1 | 11/2006 | Guidry |
| 2008/0060818 | A1 | 3/2008 | Bourgeois |

FOREIGN PATENT DOCUMENTS

| | | |
|---|---|---|
| WO | 0019060 | 4/2000 |

*Primary Examiner* — Shane Bomar
(74) *Attorney, Agent, or Firm* — Steve Rosenblatt

(57) ABSTRACT

The laterally rotating height of a fill up and circulating tool that is mounted on one of the bails supporting an elevator is made shorter with integration of design components. A power cylinder features a hollow piston which incorporates the positioning system for the fill up and circulation tool. An interior slot with a longitudinal and spiral component receives a pin extending that is supported by the cylinder. The mud line is connected below the positioning system. As the mud line descends the fill up tool moves initially axially and rotationally and then axially to align with a sting for connection thereto. Raising the mud line reverses the movement pattern. The tool is cantilevered from the mud line for sole support. Height savings allows tool use with bails of varying lengths without interference. A selectable clutch and valve allow this tool to provide additional features beneficial to operators.

20 Claims, 23 Drawing Sheets

COMPACT BAIL SUPPORTED FILL UP AND CIRCULATION TOOL

This application is a continuation in part of co-pending U.S. application Ser. No. 14/606,749 filed Jan. 27, 2015 entitled Compact Bail Supported Fill Up and Circulation Tool.

FIELD OF THE INVENTION

The field of this invention relates to fill-up and circulating tools which are mounted to a drilling rig hoisting system and more particularly to one of its bails to allow the fill-up and circulating tool to be moved aside rather than dismantled when operations such as drilling or tripping pipe are taking place.

BACKGROUND OF THE INVENTION

During the process of drilling and completing a well it is necessary to run or pull the pipe into or out of the wellbore, in a processes commonly called "tripping", where it is necessary to connect and disconnect the uppermost adjacent pieces of tubular many times. These adjacent pieces can consist of one or more individual pieces or joints of the complete tubular string. Because of problems associated with the drilling of a well it is often necessary to capture fluid from the upper end of the tubular or circulate fluid through the tubular while tripping. To capture or circulate fluid it is necessary to connect a device commonly known as a fill up and circulating tool to the upper end of the uppermost tubular. When using a top drive rig it is common to connect the top drive directly to the upper tubular by threading the top drive into the tubular. Recently it has become common to use the device illustrated in PCT/US99/22051 when attached to the top drive.

In some cases and when using a conventional "rotary rig" devices such as those illustrated in U.S. Pat. Nos. 4,997,042; 5,191,939; 5,735,348 and others are used. These devices have substantial limitations in that they cannot be used with all tubulars commonly used in the drilling and completion of a well and they cannot easily be placed in an "out of the way" position and must be removed when it is necessary to drill.

In U.S. Pat. No. 6,722,425, particularly FIG. 9A, which patent is fully incorporated herein as though actually set forth, several fill up and circulating devices are illustrated which require a handling device to assist in positioning them in sealing and coupling contact with the tubular connection and to allow sealing and coupling to the upper end of the uppermost tubular. In this application several methods for handling these devices were disclosed. One such technique for accommodating the need to get the equipment out of the way to facilitate drilling was to put the fill-up and circulating tool on swing mounts from both opposed bails and to somehow swing the fill-up and circulating tool out from between the bails to get it out of the way from the tubing in the elevator. This design involved a need for considerable clearance space to make a large arc for the swing motion and a fairly unwieldy method of hoisting and lowering the fill-up and circulating tool throughout its arcuate range of motion. Additionally, the fill-up and circulating tool had to be held in the out of the way position by cable and presented a risk of falling back down toward the tubular if the support cable failed for any reason.

Current fill-up and circulating devices illustrated in the 042', 939' and 348' patents are connected to the tubular connection of the top drive or attached to the hook of a conventional hoisting system of a rotary rig. In order to drill these devices must be removed so that the tubular can be connected to the top drive or the tubular is connected to a Kelly which is connected to the hook of a rotary rig.

Therefore, in addition to handling the fill up and circulating devices to position them at the tubular for coupling and sealing to the tubular, it is also desirable to have the handling device move the fill up and circulating device to an "out of the way" position when not sealed or coupled to the tubular. "Out of the way" meaning that the position of the handling device and any device attached to it or not in the way or inhibit the processes of rig operation and specifically the handling or tripping of the tubulars or the drilling process.

One such design is illustrated in U.S. Pat. No. 6,578,632 where a bail supported actuation system for a fill up and circulating tool is illustrated that allows the tool to be raised and lowered and rotated toward the end of the lowering movement so that alignment with the string being run in can be obtained. FIGS. 1-6 of the present application describe the operation of this prior art tool in conjunction with the following detailed description.

Referring to FIG. 1 the open side of the elevator 10 is shown supported from bails 12 and 14. The apparatus A is connected to bail 12 but could as easily be supported from the other bail 14. As best seen in FIG. 3 a frame 16 is secured to bail 12 by U-bolts 18 and 20 which extend, respectively, through clasps 22 and 24 and are secured, respectively by nuts 26 and 28. Clasps 22 and 24 are generally U-shaped and can have internal serrations where they contact the bail 12 for additional resistance to rotation of the frame 16 with respect to bail 12. Other techniques to rotationally lock the frame 16 to the bail 12 can also be employed, such as a splined connection or additional support for frame 16 from the other bail 14. On new construction, as opposed to a retrofit, the frame 16 can be made integrally with one of the bails, such as 12.

Referring to FIG. 2, an inlet pipe 30 is connected to the rig pumping and storage system to allow for flow to and from the apparatus A when sealingly connected to a tubular 32.

Referring to FIG. 3, inlet pipe 30 has a U-bend 34, which is in turn connected to the top of the fill-up and circulating tool 36. Inlet pipe 30 extends through sleeve 38. Sleeve 38 is clamped for pivotal movement about pin 40 by a clamp 42. Pin 40 extends into bracket 52, which is supported by frame 16. Sleeve 38 has an elongated slot 44, the upper portion 46 being inclined with respect to longitudinal portion 48, which is oriented generally parallel to bail 12. Inlet pipe 30 has a pin 50 which rides in slot 44. Bracket 54 is supported by frame 16 for up and down slidable movement. Link 56 is pivotally mounted at pin 58 as best seen in FIG. 4, to bracket 54. Link 56 surrounds inlet pipe 30 in a manner that permits relative rotation between them. Link 56 is mounted between flanges 60 and 62 on inlet pipe 30. Up and down movement of bracket 54 is preferably accomplished by hydraulic cylinder 64 which can selectively be used to extend or retract rod 66. Rod 66 is secured to bracket 54 by nut 68. Hydraulic cylinder 64 can be replaced by any other device which will raise and lower bracket 54.

Connected to inlet pipe 30 is a yoke 70 to which is connected link 72 at pin 74. Pin 76 connects the other end of link 72 to bracket 54.

The components now having been described, the operation of the device will now be reviewed. The intended movement of the fill-up and circulating tool 36 is intended to be from a retracted position, shown in FIG. 4 to a connected position shown in FIG. 5. Clamp 42 allows rotation of sleeve 38 as installed and link 72 has an adjustable length to define the proper length, as installed, for smooth movement of the assembly and final positioning of the fill-up and circulating tool 36 in alignment with the tubular 32. Referring to FIG. 3, the fill-up and circulating tool is in the out of the way position with rod 66 fully extended and pin 50 in the upper end 46 of slot 44. When the hydraulic cylinder 64 is actuated to move rod 66 downwardly the inlet pipe 30 moves down. The pin 50 is forced against the inclined surface 76 of the upper end 46 of slot 44. This contact induces opposed rotational motion between the inlet pipe 30 and the sleeve 38 as long as pin 50 exerts downward pressure on inclined surface 76. Sleeve 38 rotates about pin 40, while at the same time link 56 rotates about pin 58. As a result, the movement of the fill-up and circulating tool is along a near straight line into the position in FIG. 5. The inlet pipe rotates counter clockwise looking down, as seen by comparing FIG. 4 to FIG. 5. Links 42 and 56 rotate clock-wise looking down in the same Figures. The rotational movement ceases when the pin 50 enters the lower end 48 of the slot 44. This position, corresponds to an alignment of the fill-up and circulating tool with the tubular 32. Link 72 is a torque link that resists the torque created by the pin 50 moving on inclined surface 76 and, in turn creates the rotation of links 42 and 56 respectively about pins 40 and 58.

One issue with this design is that the length of the bails on different rigs is variable and some rigs the bails were sufficiently short that raising the tool to the out of alignment position with the string 32 caused the u-bend in the piping system to hit the top drive TD making the tool unusable on some rigs with shorter bails. One fix to this problem is to change the bails out to a longer length. This allows the tool enough room to swing out of the way but can also create additional problems. All drilling rigs have a defined height. When the bails are changed out for a longer version, the elevators are now lower than normal. The rig now needs to raise the top drive higher to accomplish the same height level of the elevators. In some rigs they are already using all the available travel of the top drive so changing to a longer bail length is not possible. Another issue with using longer bails when drilling is that upon approaching the rig floor, the elevators are now lower than originally intended. The drilling process has to be stopped sooner so that the lower extending elevators do not hit the rig floor. The connection for the last stand of pipe is now higher than usual and the tool joint connection maybe higher than desired. The third issue with changing out to a longer bail is time. Many top drives now have many clamps and arms that are attached to the bails. The time it takes to change bails on some offshore rigs cancels out the time savings provided with the tool. One of the objects of the present invention is to be able to provide a compact design that avoids such obstructions in situations with shorter bails. One way this is accomplished is to integrate a power piston with the flow line such that space is saved by running the mud line through a hollow piston. Another space saving feature integrates the rotational mechanism for the fill up and circulation tool about the piston and mud line going through the piston as they move in tandem. Lateral connection of the mud line eliminates a large u-bend previously employed to reduce the needed operating height for the tool between its end positions. The overall height of the articulating arm that swings into alignment with the fill up tool has been reduced to less than 50% of the overall tool length. These and other aspects of the present invention will be more readily appreciated by those skilled in the art from a review of the detailed description of the preferred embodiment and the associated drawings while recognizing that the full scope of the invention is to be determined from the appended claims.

SUMMARY OF THE INVENTION

The laterally rotating height of a fill up and circulating tool that is mounted on one of the bails supporting an elevator is made shorter with integration of design components. A power cylinder features a hollow piston which incorporates the positioning system for the fill up and circulation tool. An interior slot with a longitudinal and spiral component receives a pin extending that is supported by the cylinder. The mud line is connected below the positioning system. As the mud line descends the fill up tool moves initially axially and rotationally and then axially to align with a sting for connection thereto. Raising the mud line reverses the movement pattern. The tool is cantilevered from the mud line for sole support. Height savings allows tool use with bails of varying lengths without interference. A selectable clutch and valve allow this tool to provide additional features beneficial to operators.

DETAILED DESCRIPTION OF THE PREFERRED EMBODIMENT

Figure 7:
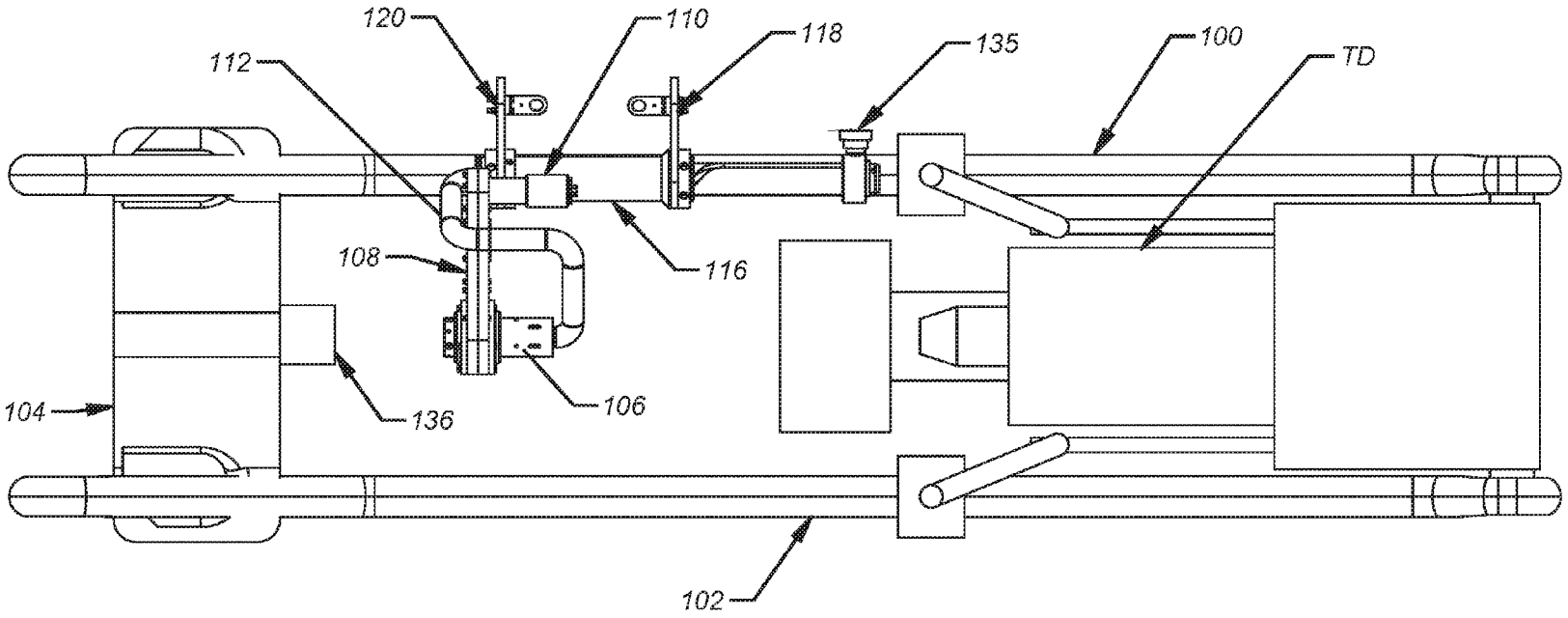
FIG. 7 is an elevation view of the fill up tool and actuation system in the up or retracted position.
Figure 8:
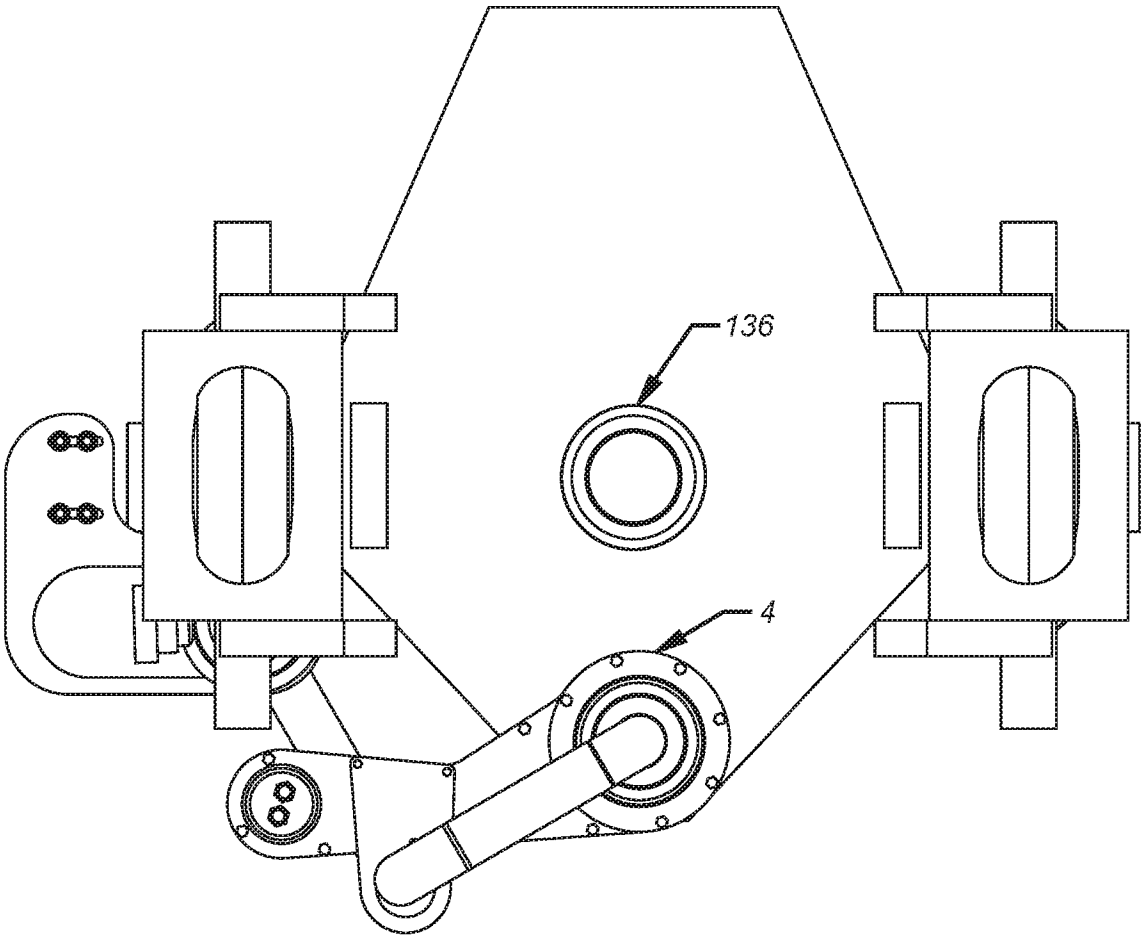
FIG. 8 is a plan view of FIG. 7 showing the offset from the tubular string supported in the elevator.
Figure 9:
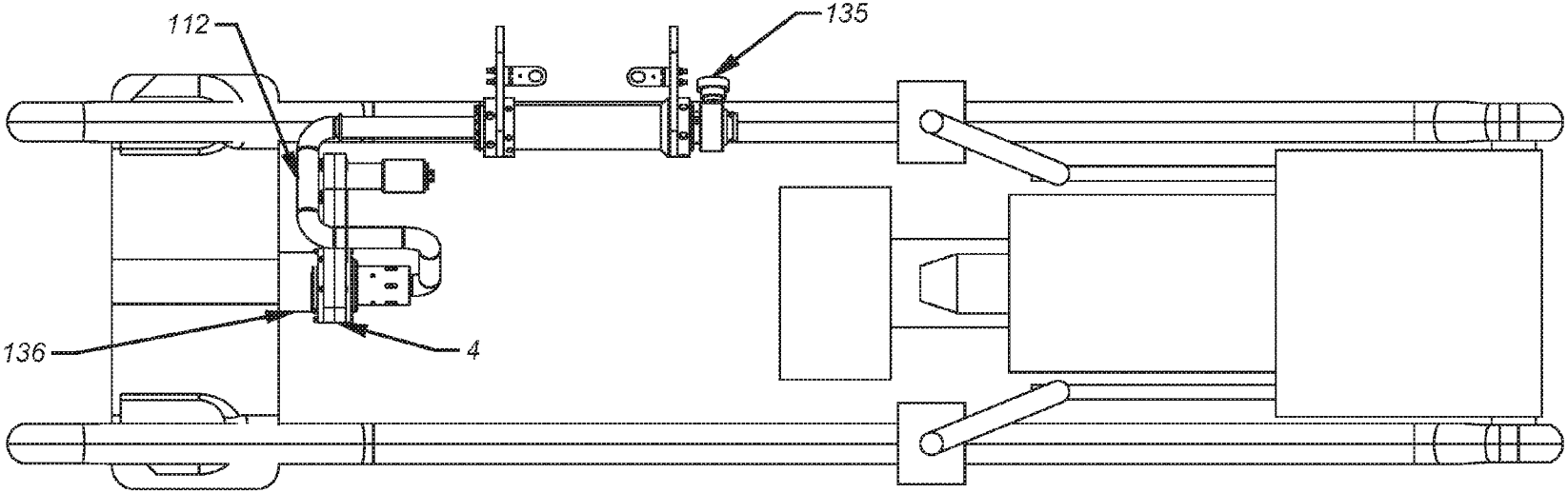
FIG. 9 is the view of FIG. 7 with the fill up tool actuated to align with the tubular string.
Figure 10:
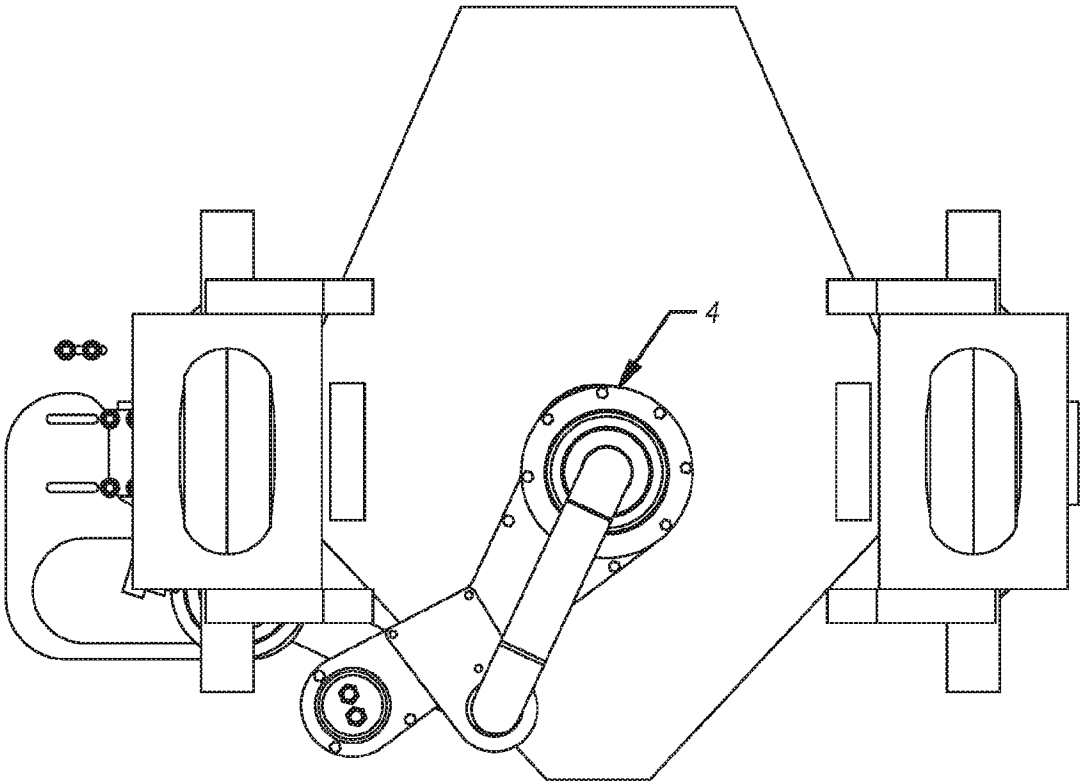
FIG. 10 is a plan view of FIG. 9 showing the alignment with the tubular string.
Figure 11:
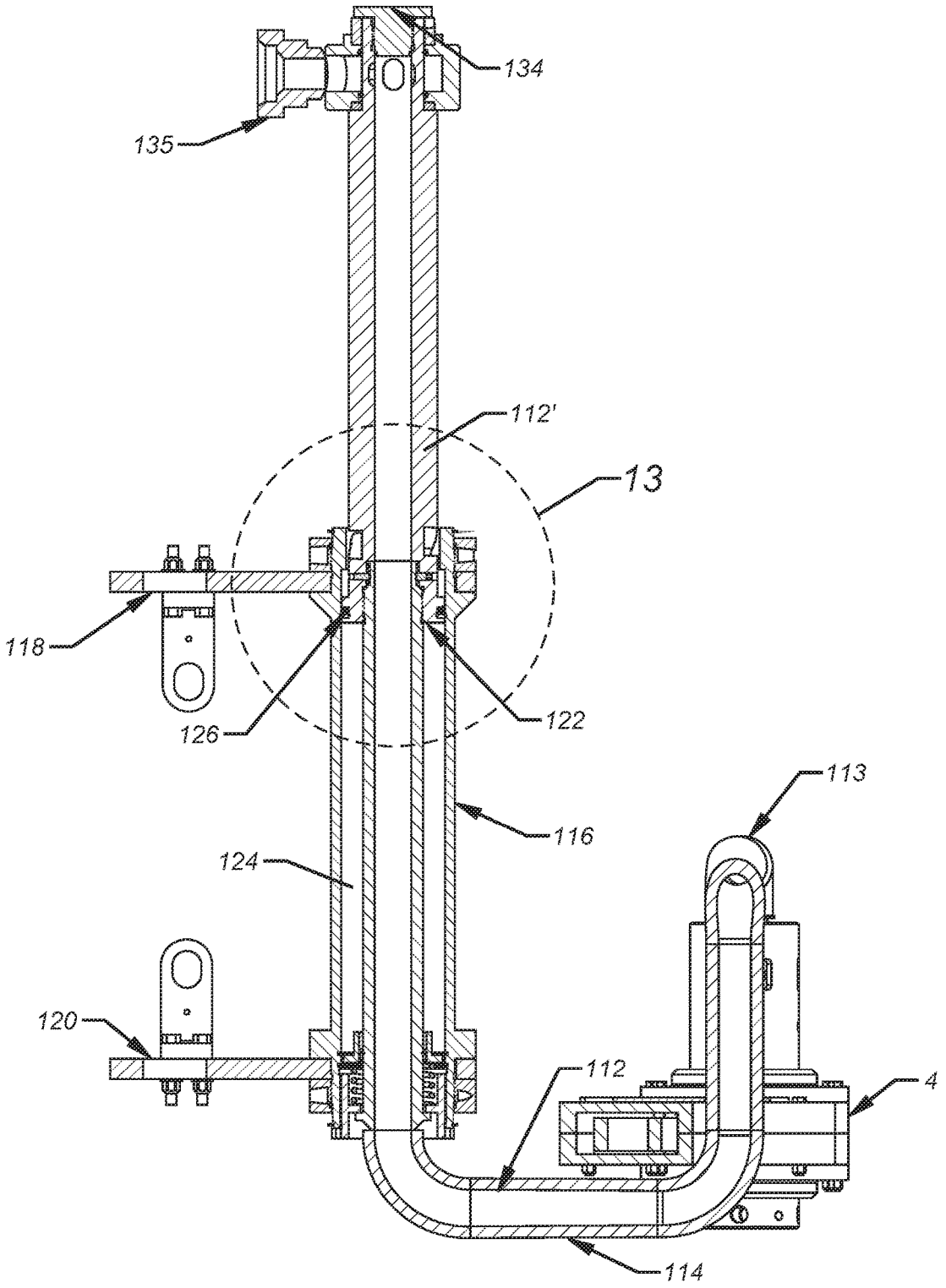
FIG. 11 is a section view of FIG. 7 showing the integration of the mud line with the piston.
Figure 12:
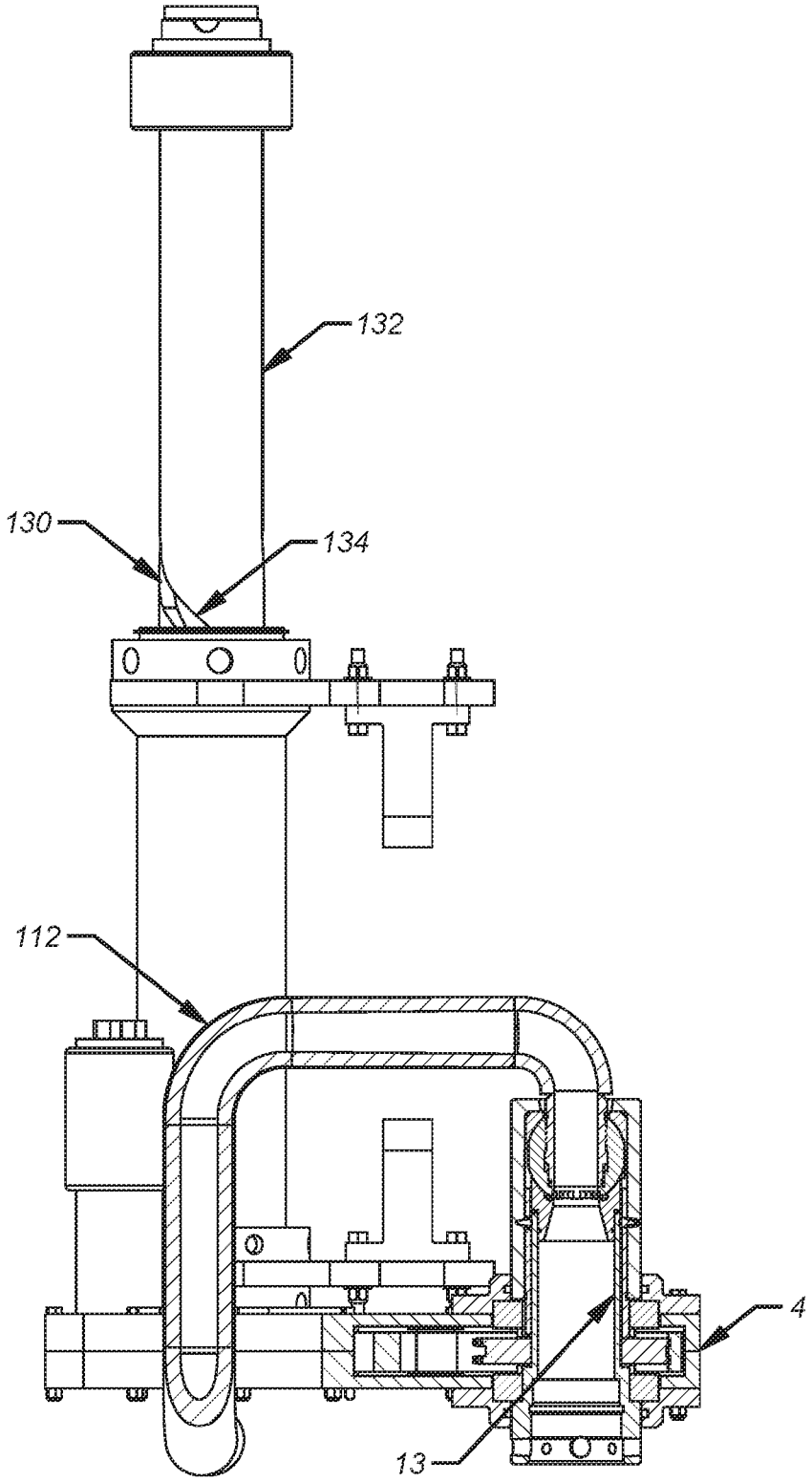
FIG. 12 is a side view of the view in FIG. 11.
Figure 13:
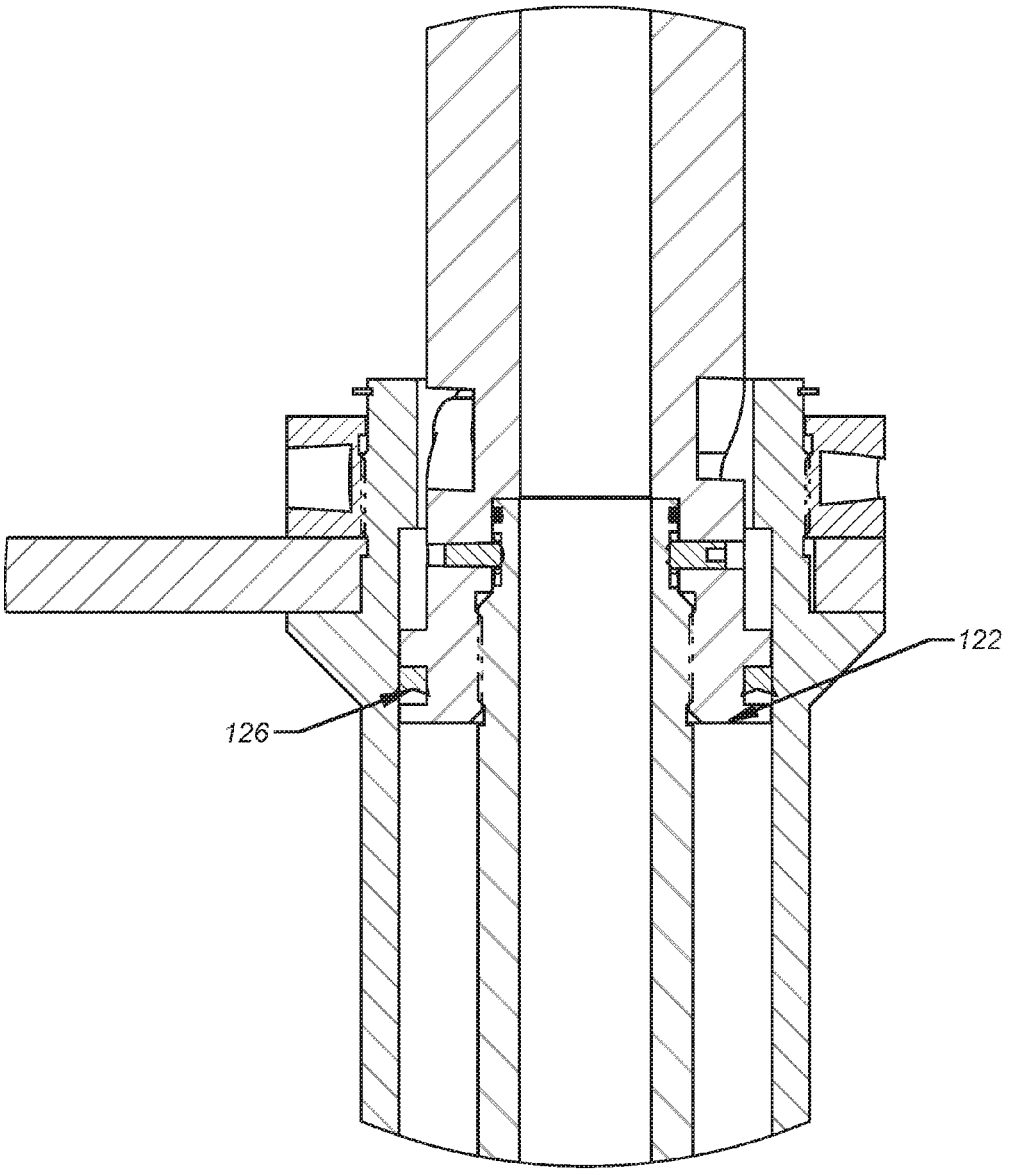
FIG. 13 is a detailed view of the piston and mud line interface shown in FIG. 7.
Figure 14:
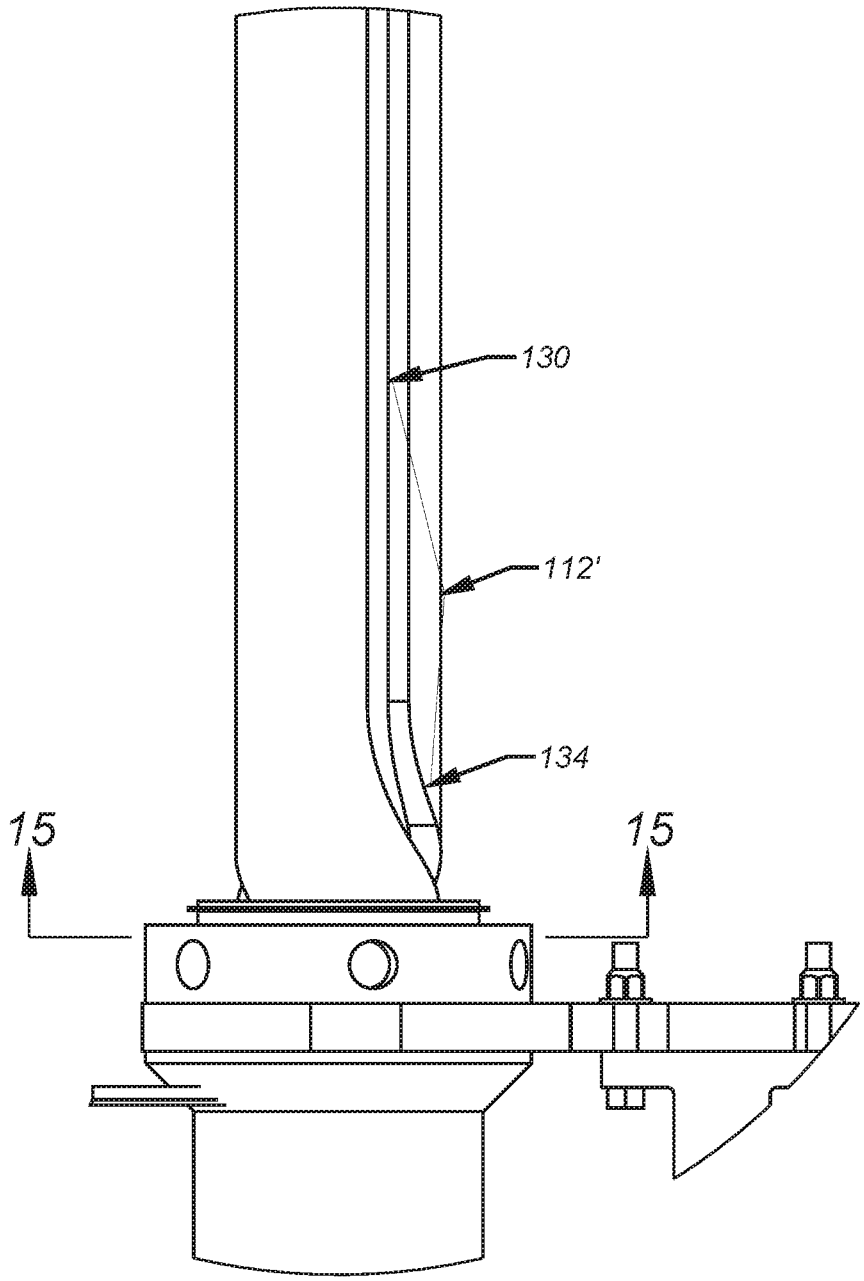
FIG. 14 is a detailed view of the spiral slot.
Figure 15:
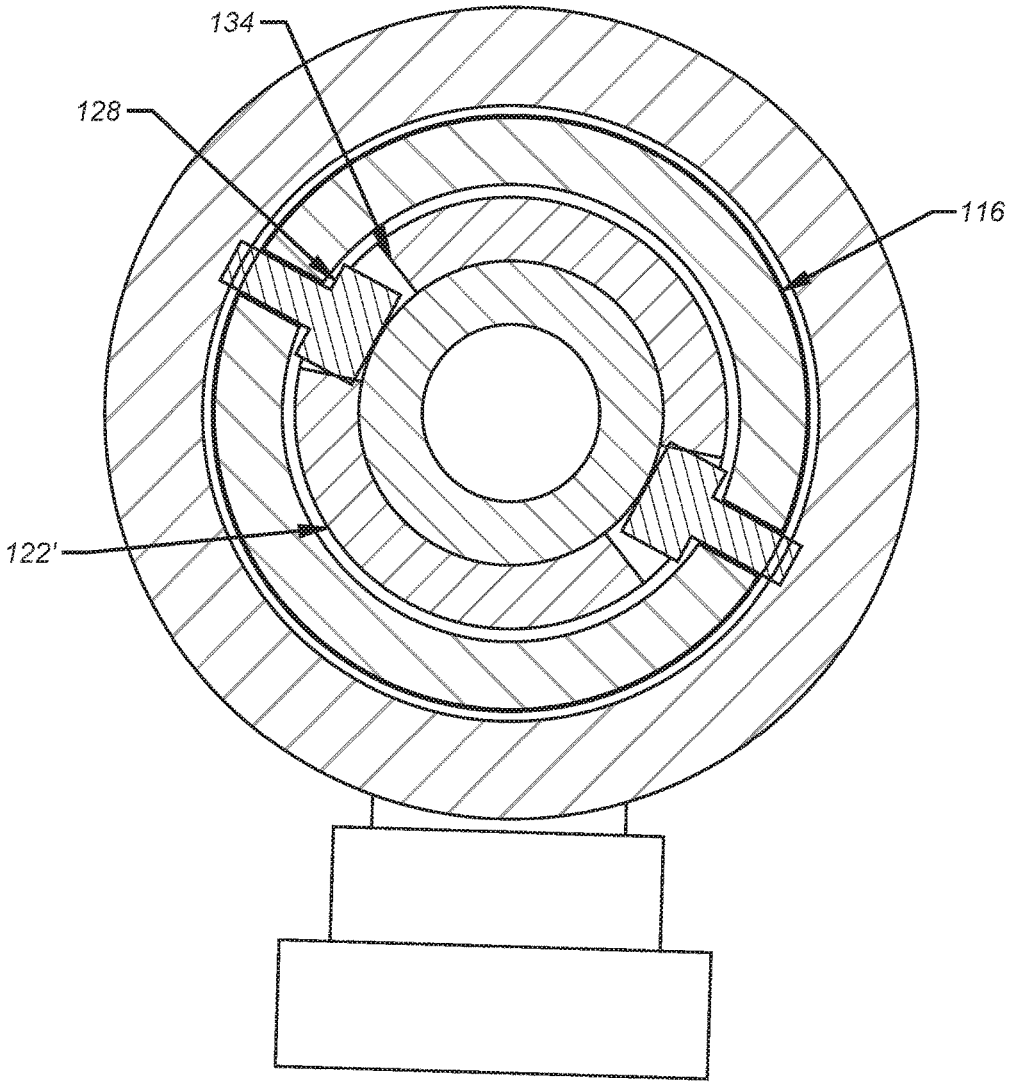
FIG. 15 is a section view of the pin in the spiral slot.

Referring to FIG. 7 bails 100 and 102 support elevator 104. The fill up and circulation tool 106 of a type known in the art is supported by support arm 112 has a general S-shape with four bends to extend from the bottom of cylinder 116 to the top of the fill up and circulating tool 106. Arm 112 is the sole support for the fill up and circulating tool 106. Gear box 108 is part of fill up and circulation tool 106. Air motor 110 operates fill up and circulation tool 106. Gearbox 108 is also supported by support arm 112. A hydraulic or air cylinder 116 is supported by spaced clamps 118 and 120 from bail 100. Cylinder 116 is thus fixed to bail 100 but can be alternatively attached to bail 102. Looking at FIG. 11, the cylinder 116 has a hollow piston 122 that forms a portion of the mud line 112. The upper mud line segment 112' is connected to the piston 122 for tandem movement. An annular variable volume chamber 124 is defined by piston 122 and the surrounding cylinder 116. The chamber 124 is enlarged when pressure is built up pushing up against seal assembly 126. When that happens the support arm 112 and its upper extension 112' move up in tandem with the piston 122. In FIG. 14 the extension 112' has a slot 130 which mates with a pin 128 that is fixedly supported to cylinder 116. Slot 130 has a lower end spiral component 134 leading to an axial orientation for the remainder of the length of slot 130. This can also be seen in detail in FIG. 15. As a result the tool 106 descends initially with rotation as pin 128 follows the spiral portion of slot 134. Descent occurs by removal of pressure from chamber 124 and using the weight of the tool 106. On further descending toward the tubular string 136, the pin 128 enters the straight portion 130 of slot 130. This happens because the mud line extension 112' has to turn to initially allow pin 128 to follow in slot 134 that has spiral shape and then extension 112' travels straight down to make a connection with the tubular. FIGS. 9 and 10 show the lowered and rotated position that has the tool 106 aligned with string 136 for connection thereto in a variety of known ways shown in U.S. Pat. No. 6,722,425 and U.S. Pat. No. 6,578,632. FIGS. 7 and 8 show the elevated position where the tool 106 is tucked away and out of alignment with the string 136 so that another joint can be added. It should be noted that string 136 can be drill string or casing or production or injection tubing.

Figure 1:
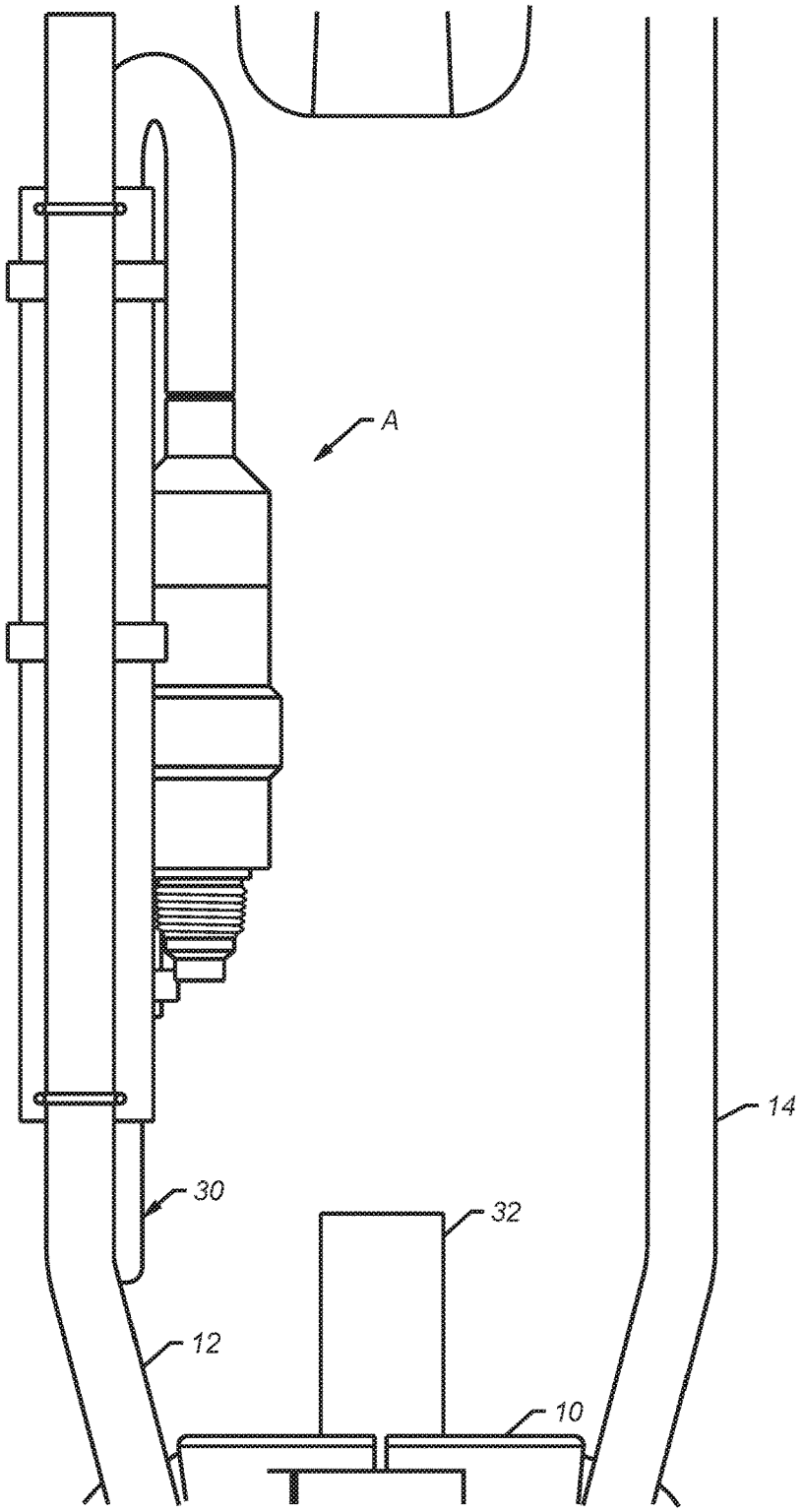
(PRIOR ART) FIG. 1
FIG. 1 is a front view of a prior art tool showing both bails with the fill-up and circulating tool in the out of the way position.
Figure 2:
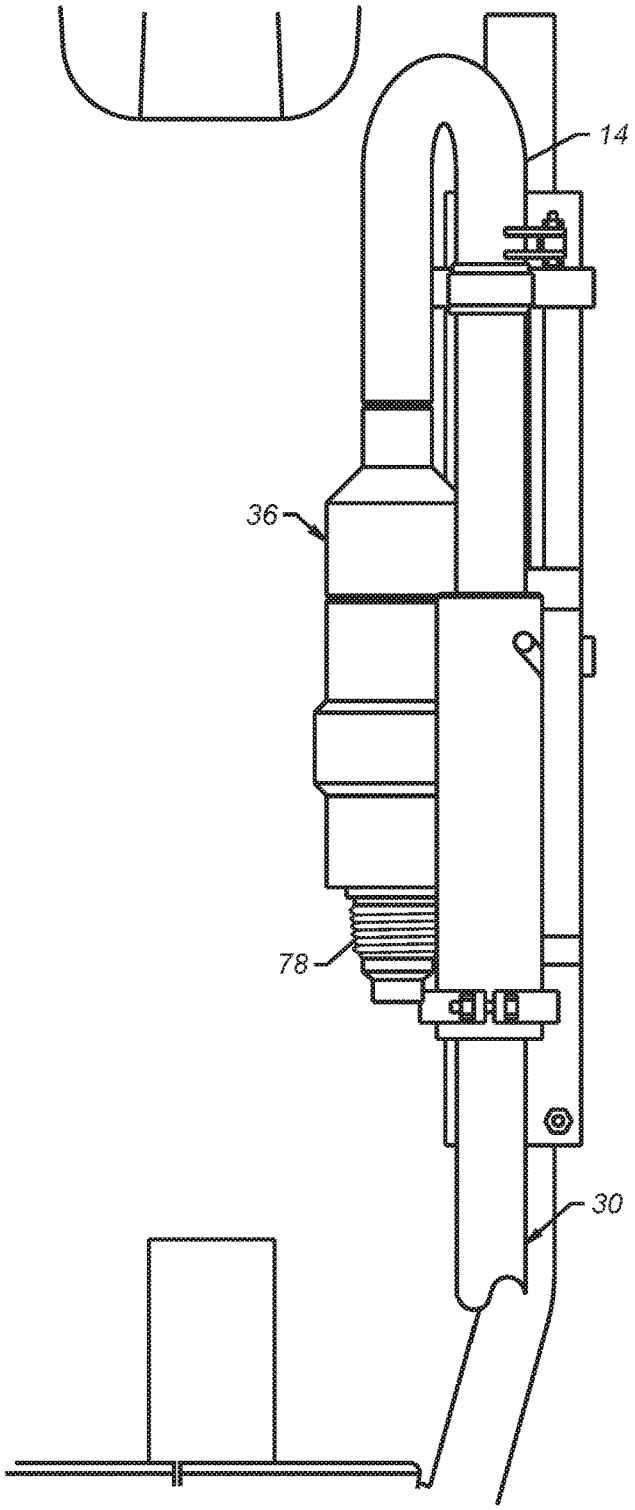
(PRIOR ART) FIG. 2
FIG. 2 is the back view of the view of FIG. 1.
Figure 3:
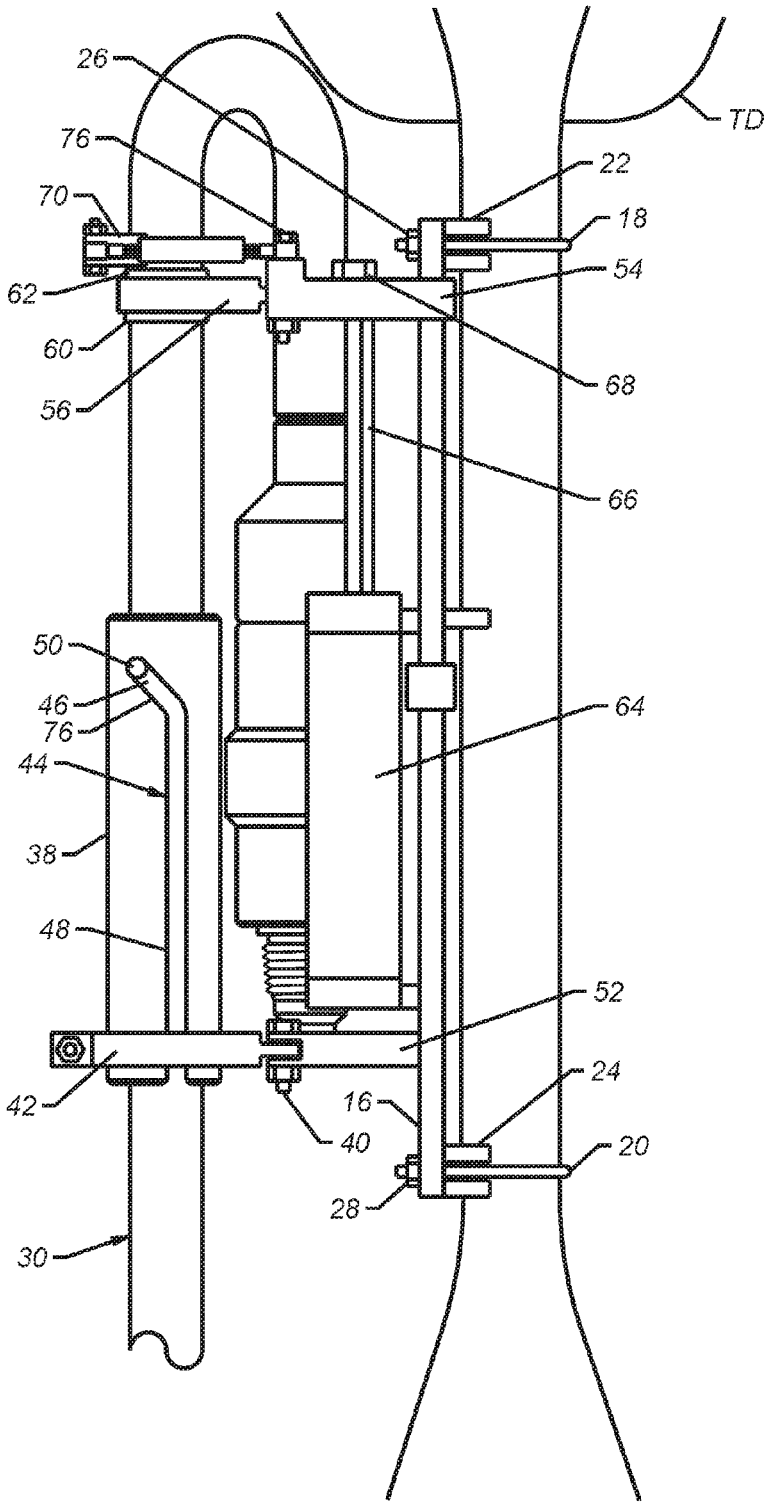
(PRIOR ART) FIG. 3
FIG. 3 is a side view of the view of FIG. 1.
Figure 4:
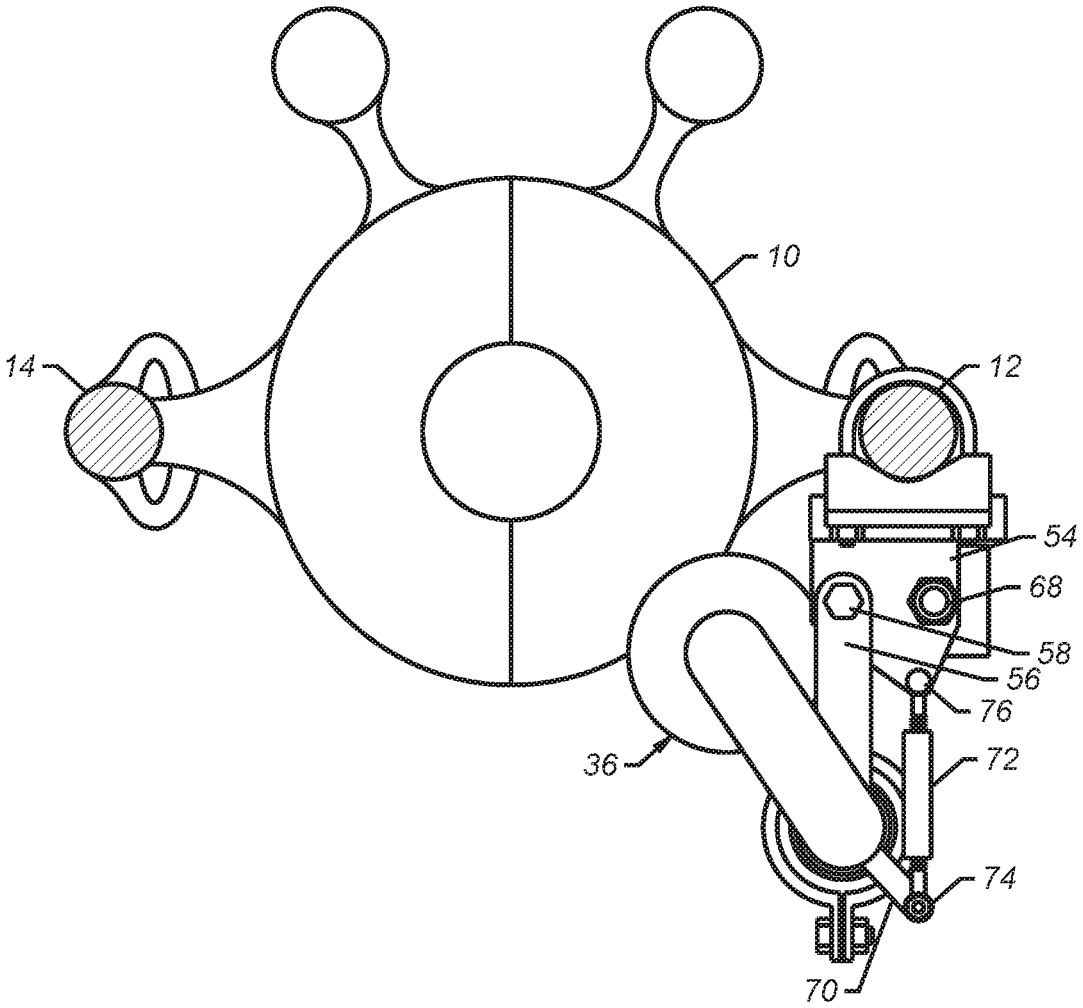
(PRIOR ART) FIG. 4
FIG. 4 is a top view of the view of FIG. 1.
Figure 5:
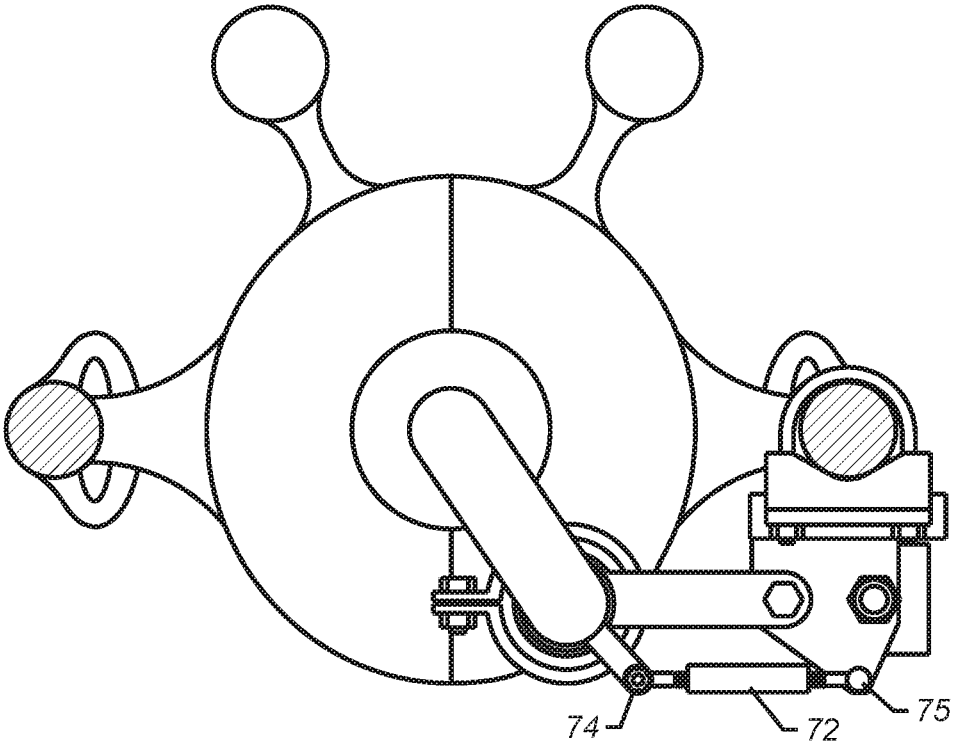
(PRIOR ART) FIG. 5
FIG. 5 is a top view of FIG. 1 showing the fill-up and circulating tool in the centered position over the elevator for connection to a tubular.
Figure 6:
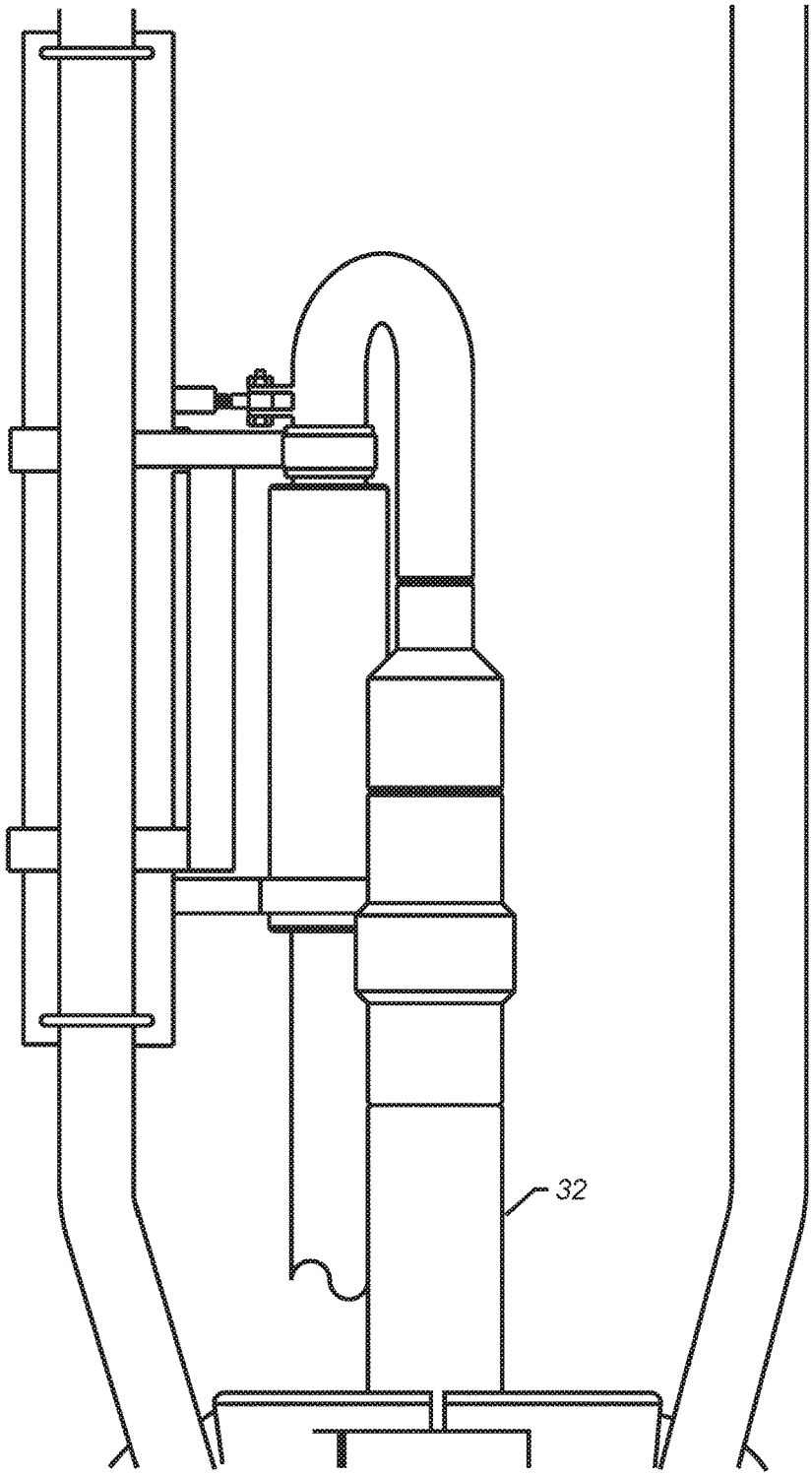
(PRIOR ART) FIG. 6
FIG. 6 is a front view of FIG. 5.

Those skilled in the art will now appreciate that the shortest length of the tool which occurs in the raised up position of FIGS. 7 and 8 is considerably smaller than the prior design described in U.S. Pat. No. 6,578,632. For example the prior design had an overall length of 68 inches from reference points 40 and 76 in FIG. 3. The whole assembly needed to be articulated over the center of the well bore to connect to the drill pipe. The present invention has an overall length of 58 inches as measured from 134 to 114 in FIG. 11 and only 29 inches need to be articulated to the center of the well bore for connection to the drill pipe as measured from 113 to 114 in FIG. 11 In the prior tool the total length of the tool needed to be articulated in over the well center. In the present invention, only 50% of the overall tool length needs to be articulated over the center of the well bore. The reasons this height reduction is possible include the fact that the mud line 112 is integrated with the hollow piston 122. Aligning the mud line extension 112' that has an external slot 130 with the hollow piston 122 and flowing the mud through the support arm further adds to the compactness of the design. The tool 106 is supported at a single location from the support arm 112. The mud connection 135 enters radially into mud line extension 112' which eliminates u-bends of the mud piping as used in the configuration of U.S. Pat. No. 6,578,632. It should be noted that typically a mud hose that is not shown is connected at 13 with a swivel connection to the mud line extension 112' so that the connection does not rotate with the extension 112'. Housing 132 is the same as extension 112'.

Figure 16:
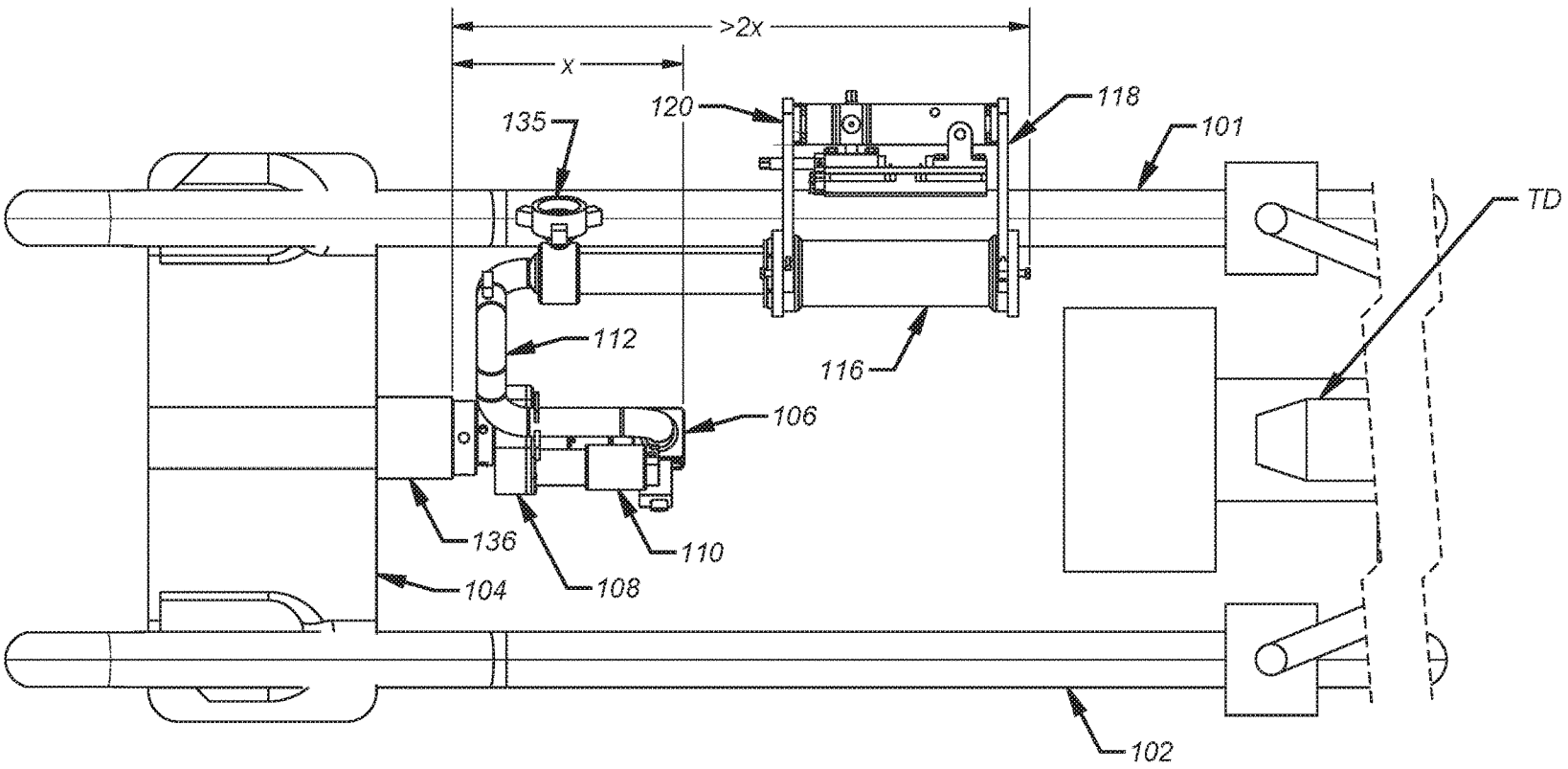
FIG. 16 is a front view of the bail mounted fill and circulation tool engaged with the tubular.
Figure 17:
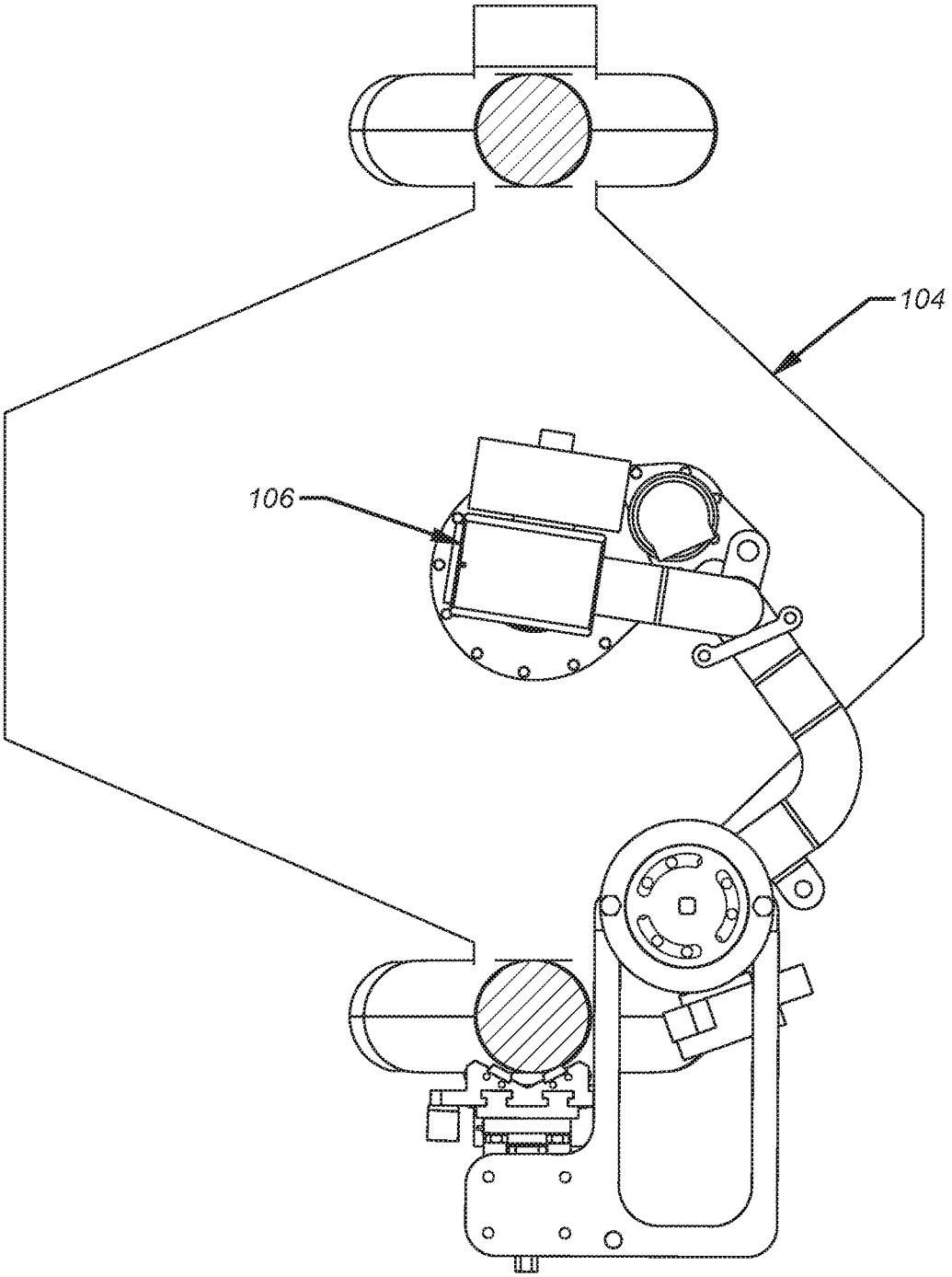
FIG. 17 is the top view of the bail mounted fill and circulation tool engaged with the tubular.
Figure 18:
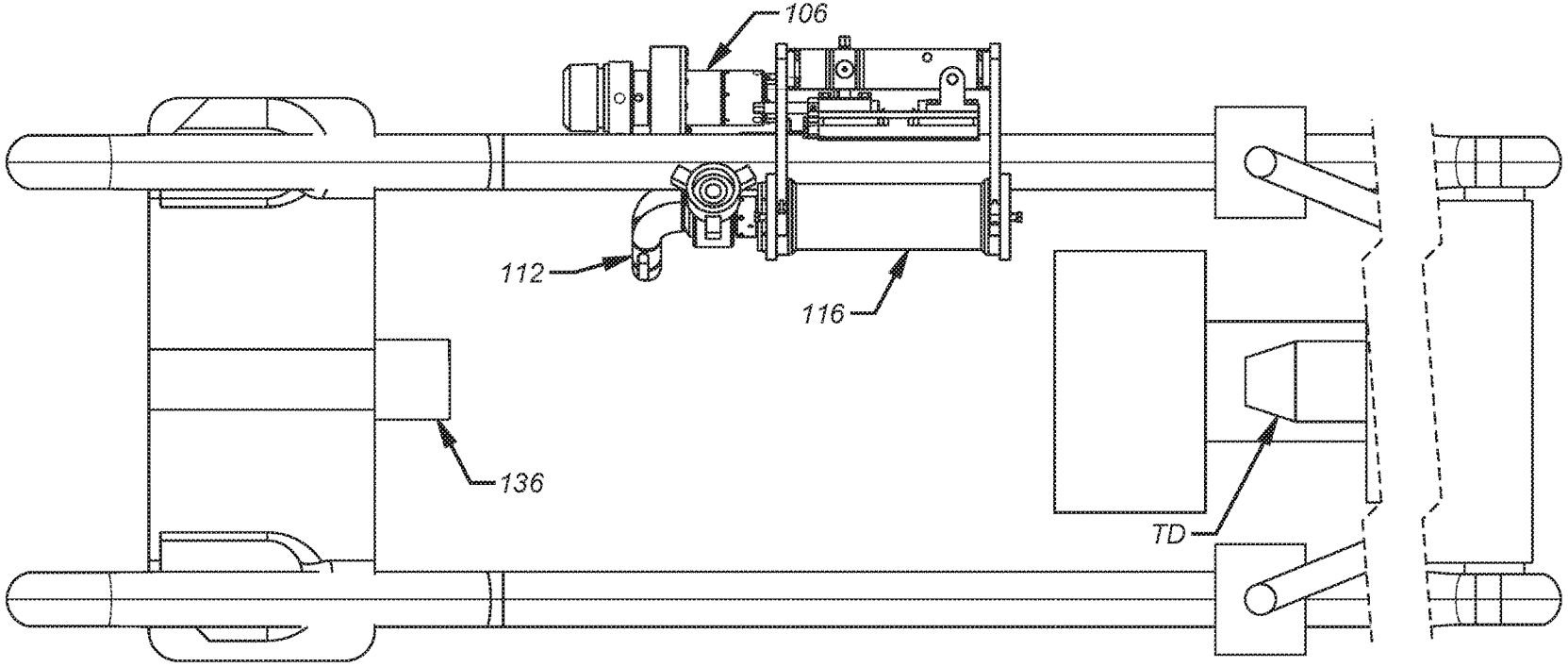
FIG. 18 is a front view of the bail mounted fill and circulation tool disengaged with the tubular.
Figure 19:
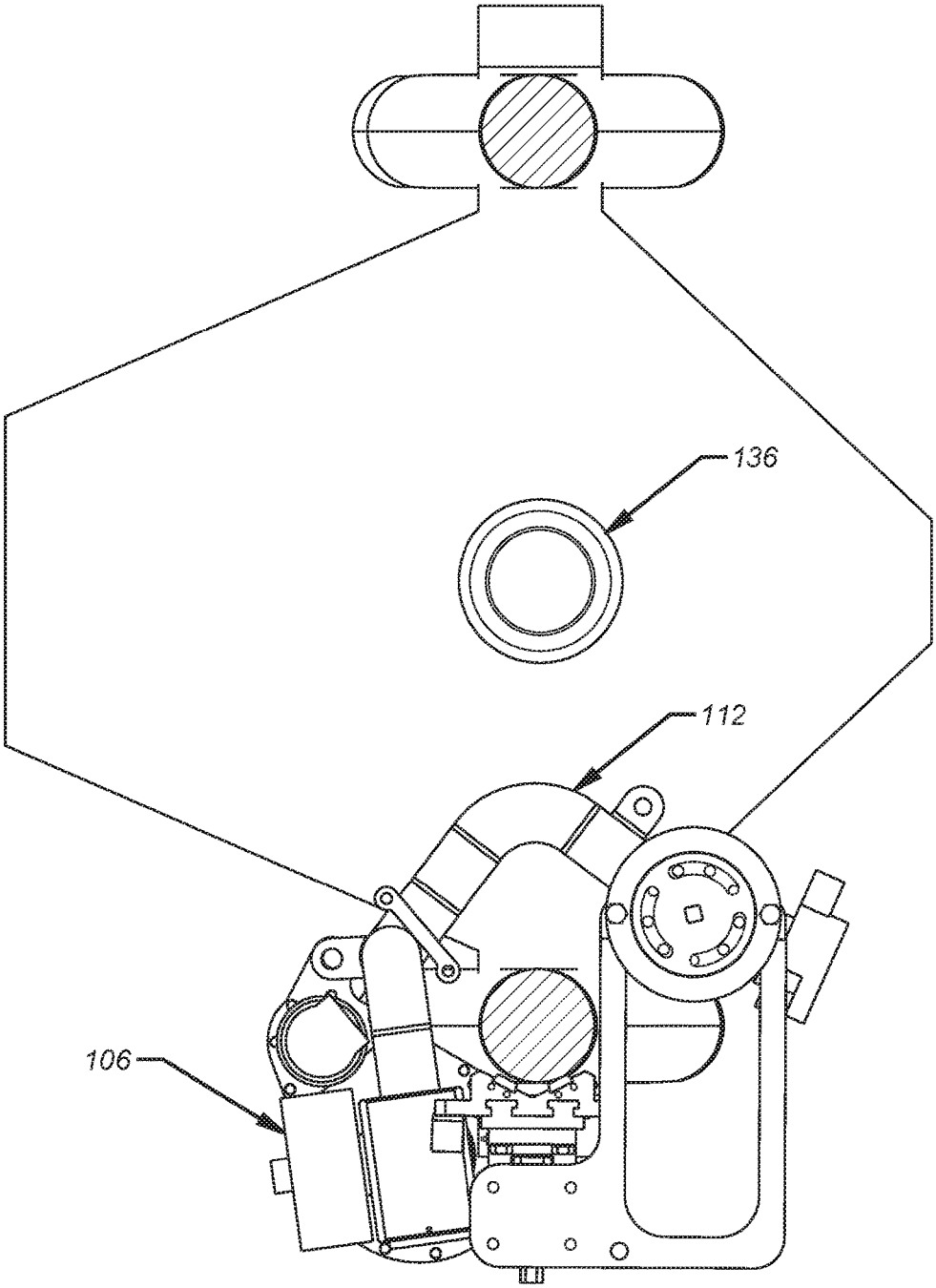
FIG. 19 is a top view of the bail mounted fill and circulation tool disengaged with the tubular.
Figure 20:
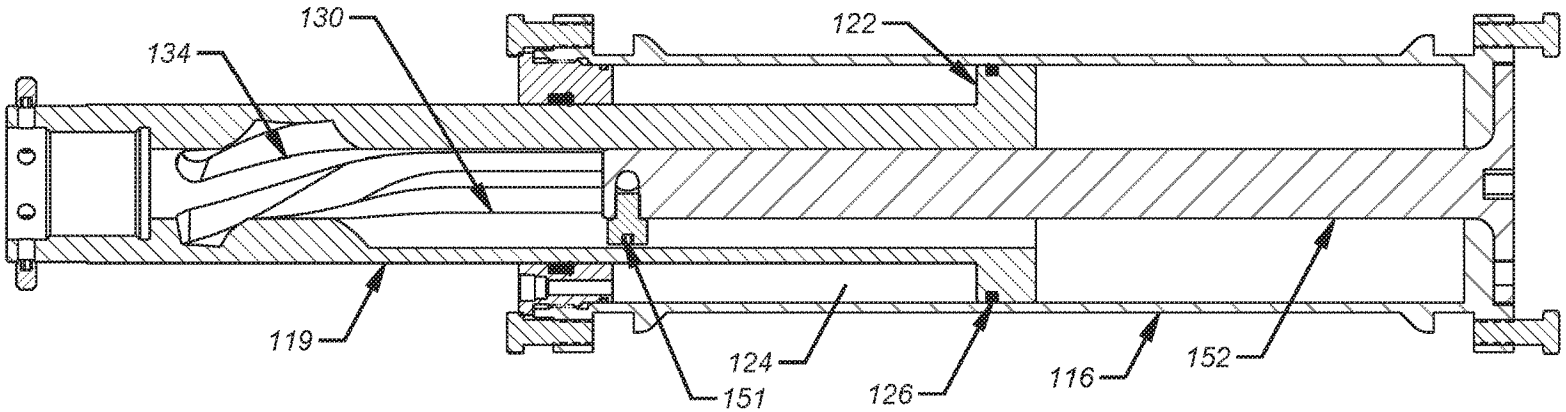
FIG. 20 is a section view of the positioning system when the fill and circulation tool is engaged with the tubular.
Figure 21:
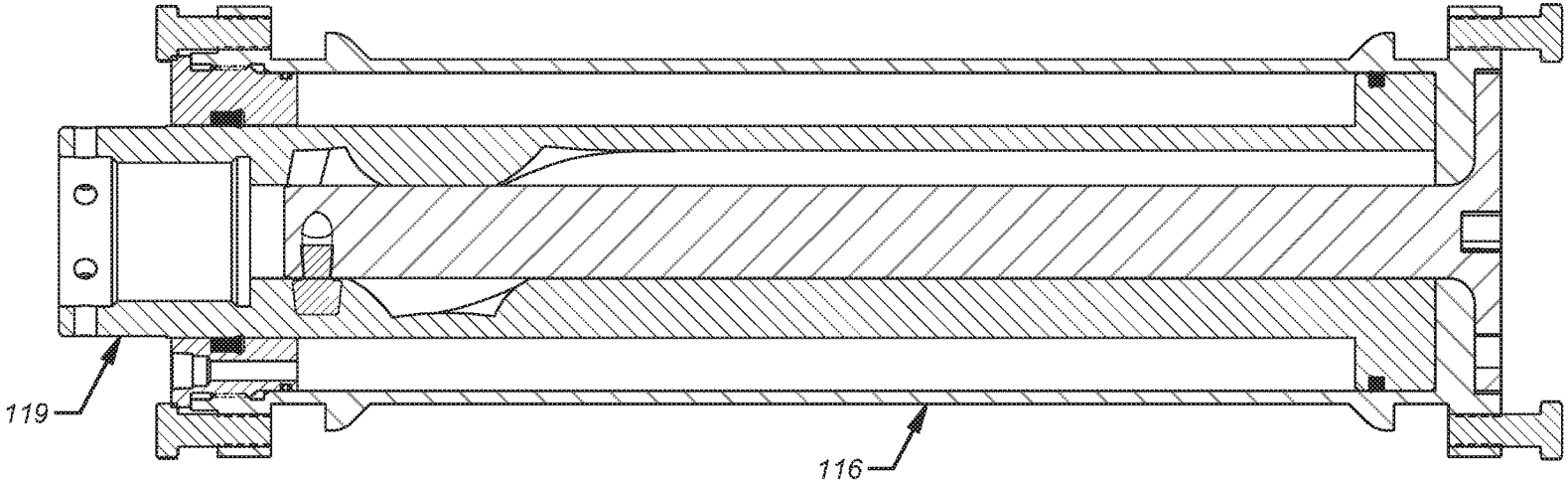
FIG. 21 is a section view of the positioning system when the fill and circulation tool is disengaged with the tubular.

In an alternative embodiment, an even more compact design is shown in FIGS. 16-23. Referring to FIG. 16 bails 101 and 102 support elevator 104. The fill up and circulation tool 106 of a type known in the art is supported by support arm 112 that has a general S-shape with four bends to extend from the bottom of cylinder 116 to the top of the fill up and circulating tool 106. Arm 112 is the sole support for the fill up and circulating tool 106. Gear box 108 is part of fill up and circulation tool 106. Air motor 110 operates fill up and circulation tool 106. Gearbox 108 is also supported by support arm 112. A hydraulic or air cylinder 116 is supported by spaced clamps 118 and 120 from bail 101. Cylinder 116 is thus fixed to bail 101 but can be alternatively attached to bail 102. Looking at FIG. 17, the fill up and circulation tool 106 is positioned over center and connected to the tubular 136 which cannot be seen. FIGS. 18 and 19 show the fill up and circulation tool out of the way. In FIG. 18 the tool is in the retracted position which moves fill up and circulating tool 106 up and out of the way to allow the top drive TD to connect to tubular 136 if needed. FIG. 19 is a top view of the disengaged position and shows the misalignment of fill up and circulation tool 106 and tubular 136. The rotational mechanism shown in detail in FIGS. 20 and 21 features a stationary cylinder acting as a housing 116. Inside is a movable piston 122 driven with compressed gas admitted into chamber 124 with reverse motion occurring when gas pressure is bled out of chamber 124. Pin 151 is attached to mandrel 152 and j-slot pattern 130, 134 is supported by extension 119 that moves axially and then rotates when slot 134 is engaged by pin 151. Application of gas pressure to chamber 124 from the FIG. 20 position has the effect of rotation as pin 151 uses a curved portion of the j-slot 130 to rotate extension 119 and then pure axial movement of tubular extension 119 to raise arm 112 while not rotating arm 112 as pin 151 guides in the straight portion of slot pattern 130. As pressure is relieved out of chamber 124 arm 112 descends with tubular housing 119 as housing 119 is guided by pin 151 to ride a straight part of the j-slot 130. Further removal of pressure in chamber 124 allows the weight of the assembly to rotate housing 119 and with it arm 112 to place the fill up and circulating tool 106 in line with the tubular string 136 as shown in FIGS. 16 and 17. As opposed to FIG. 11 where flow runs through piston 122. In FIGS. 16 and 18 the fluid inlet 135 is below housing 116 and is between rotating tubular extension 119 and arm 112 and enters in a perpendicular direction to j-slot 130. The overall assembly height is reduced as the turning mechanism of the j-slot 138 is located nested within piston 122 as opposed to extending above the piston 122 and extending out the top of housing 116. The same amount of rotation and vertical movement of arm 112 is obtained but with a far shorter overall height than in the FIG. 11 layout. This makes the tool more versatile in low clearance installations where there is no room for the extension tube 112' shown in FIG. 11 because the bails on a particular job are too short to allow room for tube 112' to swing around. In essence the turning function on arm 112 is nested in housing 116 instead of extending above it as in FIG. 11 to allow a dramatic decrease in overall height of the assembly in the order of 50%.

Figure 22:
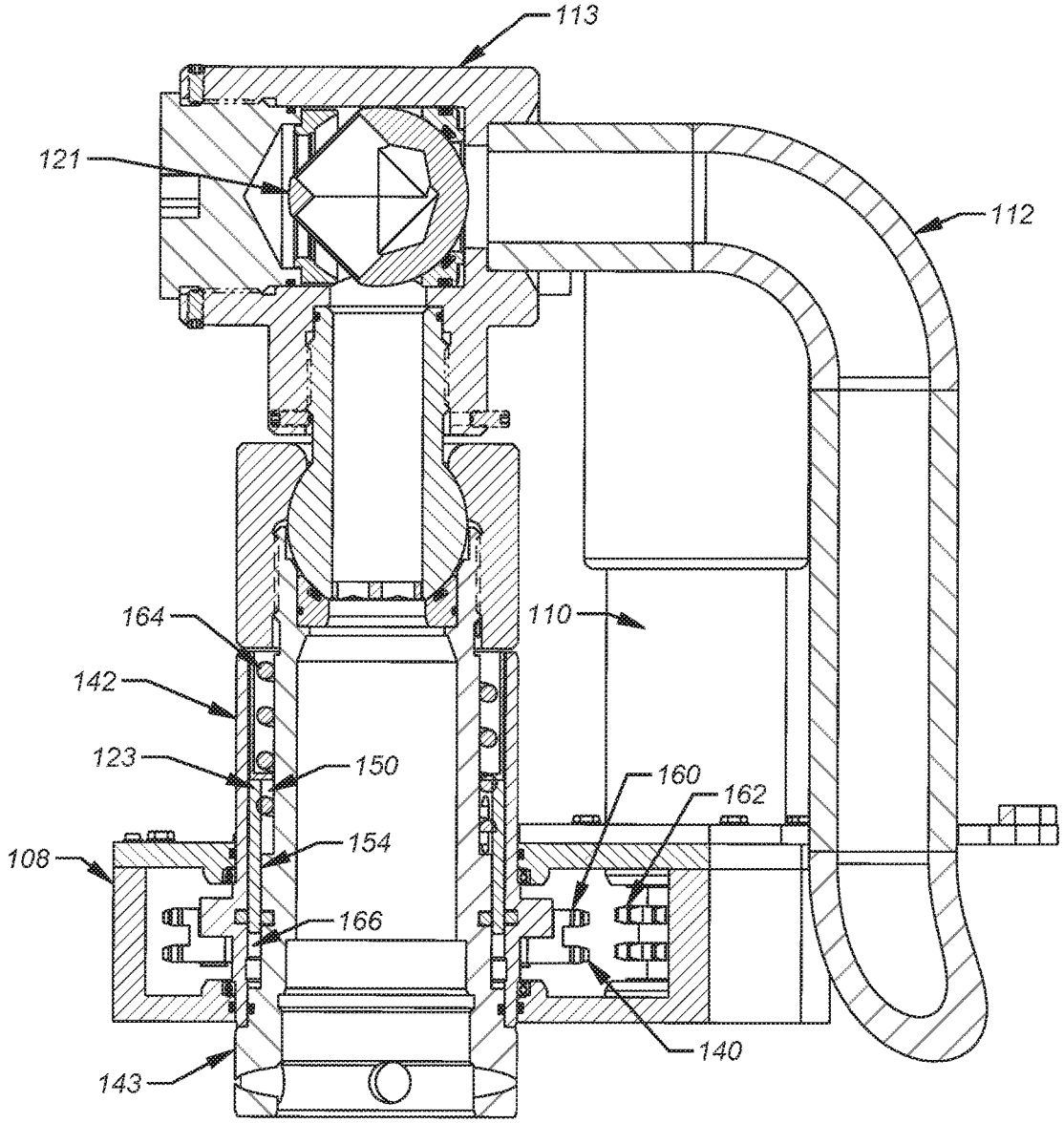
FIG. 22 is as a section view of the fill and circulation tool that include the actuating ball valve and clutch.
Figure 23:
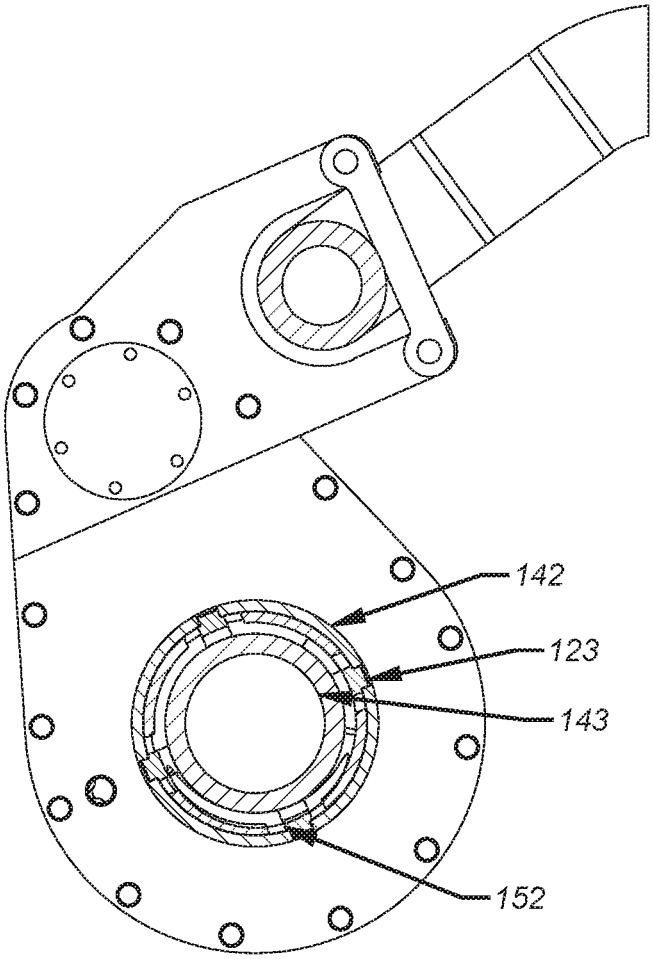
FIG. 23 is a section view of the clutch splines.

FIGS. 22 and 23 show in detail other features not present in the embodiment of FIGS. 7-15. Arm 112 has a remotely actuated and preferably compressed air operated valve 121 to assure flow cutoff more certainly than check valves used in the past. Furthermore there is a clutch 123 allows selective disconnection to the tubular string 136 by disconnecting a splines 150 recess 152. Drive 140 has spaced sprockets 160 and 162 connected by a chain that is not shown. When the clutch 123 is engaged sprocket 160 rotation turns mandrel 143 and adapters (not shown) connected to mandrel 143. Spring 164 provides bias on clutch 123 toward the disengaged position shown in FIG. 22. Pressure in chamber 166 that communicates with the interior of gearbox 108 raises sleeve 154 against the bias of spring 164 so that rotation of sprocket 160 will not turn the mandrel 143. Removal of compressed air pressure allows spring 164 to push splines 150 into respective slots 152 so that rotation of the sprocket 160 again turns mandrel 143. The configuration can be reversed so that application of compressed air can engage the clutch as opposed to disengaging the clutch as shown in FIG. 22. The clutch feature takes away the need to disconnect from the string 136 with the tool 106 if there was a need to rotate the string 136 with rig equipment that is not shown. The FIG. 7 design required physical disconnection but the addition of the clutch 123 removes that need and speeds up operations.

From a longitudinal height perspective the vertical height at the fill up and circulation tool 106 is less than half the height overall adjacent a supporting bail such as 101.

The above description is illustrative of the preferred embodiment and many modifications may be made by those skilled in the art without departing from the invention whose scope is to be determined from the literal and equivalent scope of the claims below:

I claim:

1. An apparatus, mounted to a hoisting system in a rig having a longitudinal axis, defined by a pair of bails supporting an elevator, for selective positioning of a fill-up and circulating tool in a first position for contact with a tubular in the elevator and in a second out of the way position to allow drilling or tripping pipe, comprising:

a frame supported on the hoisting system;

a mechanism mounted to said frame and supporting the fill-up and circulating tool, said mechanism powered by a driving member in a housing;

said mechanism capable of selectively translating at least a portion of the fill-up and circulating tool to move the fill-up and circulating tool into or out of alignment with a tubular in the elevator or to raise or lower the fill-up and circulating tool for selective contact with the tubular;

said mechanism comprising nested axial movement and rotation devices in said driving member.

2. The apparatus of claim 1, further comprising:

a flow line to said fill up and circulating tool further comprising a connection movable in tandem with said driving member.

3. The apparatus of claim 2, wherein;

said axial movement and rotation devices and said flow line are perpendicular.

4. The apparatus of claim 2, wherein:

said driving member comprises a hollow piston in a cylinder with said flow line out of fluid communication with said hollow piston.

5. The apparatus of claim 4, wherein:

said axial movement and rotation devices comprise a pin and slot combination to selectively rotate the fill-up and circulating tool in addition to non-rotational axial movement of the fill-up and circulating tool.

6. The apparatus of claim 5, wherein:

said slot is formed in an interior wall of said hollow piston and said pin is fixedly supported to a stationary mandrel and engages said slot.

7. The apparatus of claim 6, wherein:

said stationary mandrel is fixedly mounted to said cylinder.

8. The apparatus of claim 4, wherein:

said flow line moves in tandem with said hollow piston.

9. The apparatus of claim 2, wherein:

said fill up and circulating tool is supported by said flow line.

10. The apparatus of claim 9, wherein:

said flow line comprising a vertical component that translates along and rotates about a vertical axis and a lateral component that extends from said vertical component to support the fill up and circulating tool.

11. The apparatus of claim 5, wherein:

said hollow piston is rotatably mounted in said cylinder and raises and rotates said fill up and circulating tool when an annular cavity defined between said hollow piston and said cylinder is pressurized.

12. The apparatus of claim 11, wherein:

pressurizing said annular cavity raises said fill up and circulation tool and rotates said fill up and circulation tool with respect to the supporting bail.

13. The apparatus of claim 12, wherein:

removing pressure from said annular cavity allows the weight of said fill up and circulation tool to be used to lower and rotate said fill up and circulating tool toward and into alignment with said tubular.

14. The apparatus of claim 1, wherein:

said frame and said mechanism having an overall height along a longitudinal axis substantially parallel to one of said bails;

said mechanism having a lateral component that selectively pivots about said longitudinal axis, said lateral component having a component height less than 50% of said overall height.

15. The apparatus of claim 4, wherein:

said hollow piston in said cylinder defines a chamber in between said hollow piston and said cylinder, wherein pressurizing said chamber translates and rotates said hollow piston with said flow line to raise and rotate said fill up and circulation tool away from said tubular;

whereupon releasing of pressure in said chamber employs the weight of said fill up and circulating tool to lower and rotate said fill up and circulating tool toward said tubular.

16. The apparatus of claim 2, wherein:

said flow line extends into a top end of said fill up and circulating tool for sole support of said fill up and circulating tool.

17. The apparatus of claim 2, further comprising:

a remotely operated ball valve in said flow line.

18. The apparatus of claim 2, further comprising:

a clutch disposed in said flow line to allow rotation of the tubular in the elevator without disconnection of said fill-up and circulating tool.

19. The apparatus of claim 18, wherein:

said clutch is disposed in a connection between said fill-up and circulating tool and the tubular in the elevator, said clutch disengages a drive from being operably connected to said connection to facilitate rotation of the tubular in the elevator without disconnecting said connection from the tubular in the elevator.

20. The apparatus of claim 19, wherein:

said clutch is operable remotely with compressed gas to move a spline relative to a groove to selectively connect or release said drive from said connection.

* * * * *